United States Patent [19]

Blatt

[11] 4,254,799

[45] Mar. 10, 1981

[54] LAPPED SPOOL VALVE ASSEMBLY

[76] Inventor: Leland F. Blatt, 31915 Groesbeck Hwy., Grosse Pointe Shores, Mich. 48026

[21] Appl. No.: 33,099

[22] Filed: Apr. 25, 1979

[51] Int. Cl.[3] ..... F15B 13/042

[52] U.S. Cl. ..... 137/625.69; 137/625.66

[58] Field of Search ..... 137/625.66, 625.69

[56] References Cited

U.S. PATENT DOCUMENTS 3,756,280 9/1973 Parquet ..... 137/625.67

FOREIGN PATENT DOCUMENTS 2108705 8/1972 Fed. Rep. of Germany ..... 137/625.69

*Primary Examiner*—Gerald A. Michalsky

*Attorney, Agent, or Firm*—Cullen, Sloman, Cantor, Grauer, Scott & Rutherford

[57] ABSTRACT

A valve assembly has an elongated body with an axial bore which is honed to a fine finish, axially apertured end caps sealed over opposite ends of the body, a pressure port, cylinder ports and exhaust ports with associated passages communicating with the bore. A valve spool assembly is reciprocally nested and sealed within the bore for controlling flow of pressure fluid through the respective ports and passages. The spool assembly is honed to a fine finish to match the bore with a minimal clearance whereby the spool sealingly engages said bore. The spool assembly includes a pair of symmetrical axially aligned spools which are interconnected to provide flexibility of the spool parts.

5 Claims, 7 Drawing Figures

FIG. 3
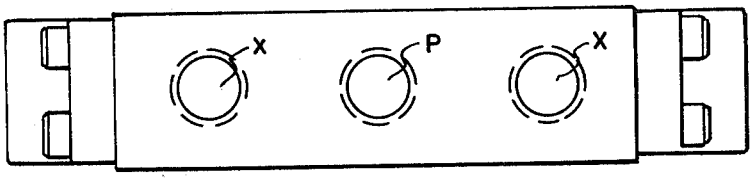
FIG. 1
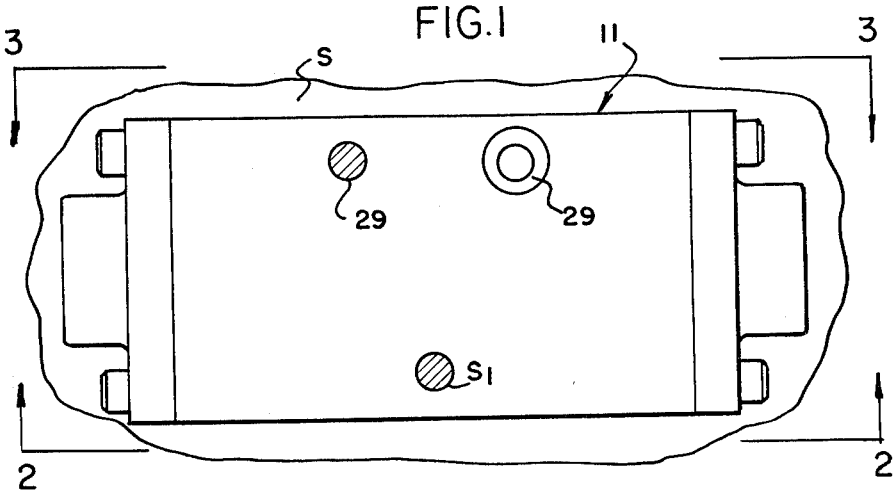
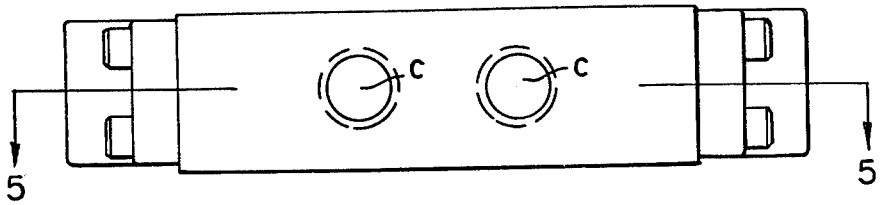
FIG. 2
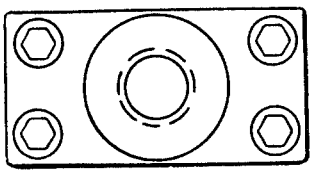
FIG. 4

FIG. 5
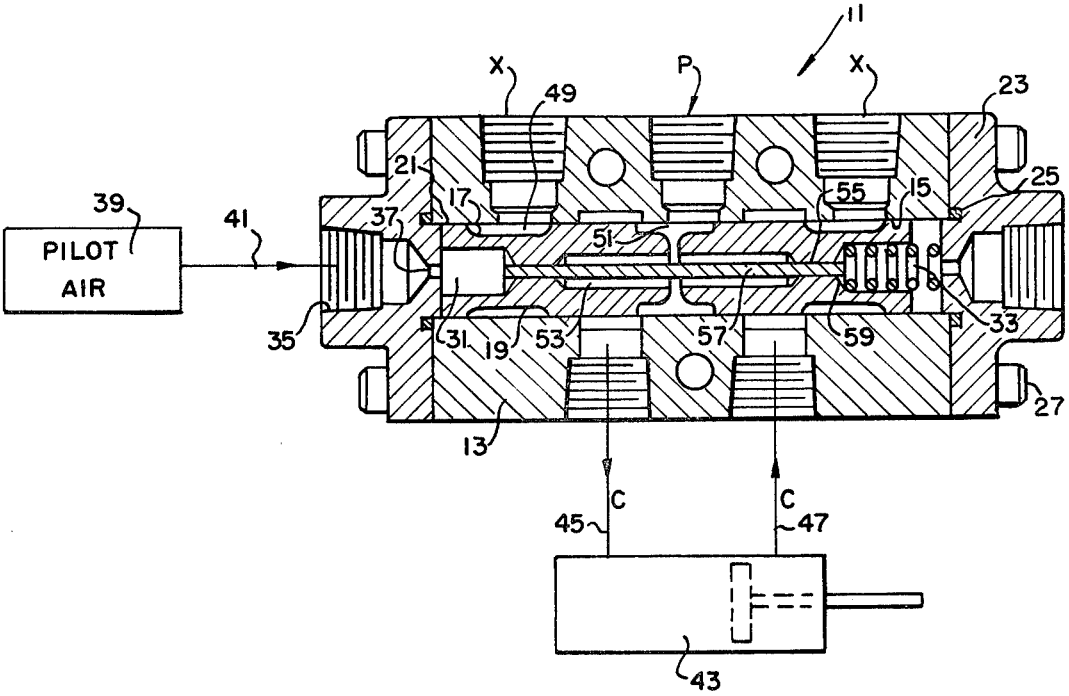
FIG. 6
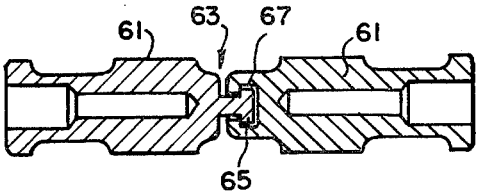
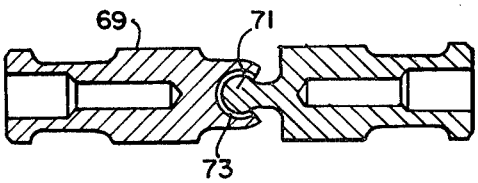
FIG. 7

LAPPED SPOOL VALVE ASSEMBLY

BACKGROUND OF THE INVENTION

Heretofore valve assemblies of the present type have been complex in construction providing numerous annular rings, spacers and O-ring SEALS stacked inside the valve body to provide chambers and passageways with seals for a slidable spool movable therein. To provide for greater tolerance between the spool and valve body, required a series of annular sealing members mounted upon the spool for cooperative registry with the bore as the spool is selectively moved to various control positions for regulating the flow of pressure fluids through the valve body.

In cases where the valve body is secured upon a support, fastening pressure often created warping of the valve body. Without suitable clearance between the spool and body, the spool would cease to be slidably positioned within the valve body either by air pressure or by spring loading.

An example of such prior art construction is shown in U.S. Pat. No. 3,017,901 dated Jan. 23,1962. This patent discloses the use of numerous annular rings, spacers and O-ring seals forming a part of the bore for receiving the loosely disposed valve spool and wherein numerous wiping seals are required to be mounted upon the spool to maintain a seal between the spool and the bore defined during movement of the spool into various control positions.

SUMMARY OF THE INVENTION

In the present construction, the aforesaid and objectionable annular rings and spacers and O-ring seals and spool seals are all omitted by a construction wherein the body has a bore which has been honed to a fine finish and wherein a spool of substantially the same diameter as said bore is similarly honed to a fine finish for a fit within said bore having a minimal clearance. The clearance is in the range of 10 millionths of an inch. Accordingly while the spool is movable within the bore either under spring pressure or air pressure, the annular portions of the spool which engage the bore are in effect in sealing engagement therewith for effectively controlling the movement of fluids through the various ports and passages in the body as defined by the positioning of the spool therein.

With such minimal clearance the valve spool is made up of a plurality of components or symmetrical elements each of which extends only a part of the length of the bore and wherein there is a flexible connection between spool elements which define the spool assembly. This additional flexibility provides the capability of the valve assembly being movable within the bore at the same time remaining in sealing engagement therewith. This flexibility of the spool assembly will eliminate any sticking of the valve assembly within the bore which might be caused by body warpage due to the anchoring of the body upon a support surface. Even should there be some warpage of the valve body, the flexibility of the valve assembly assures that the spool will slide smoothly in the body bore.

Various types of connections may be made between the valve spools which make up the valve assembly to define the flexible connection therebetween. In the illustrative embodiment there is shown a hardened steel wire which is loosely interposed between a pair of spools at its ends secured to the respective spools. Other means of flexibly connecting these spools include a key and slot connection, a ball and socket connection or a universal joint.

This represents an improvement over many spool and sleeve arrangements, most of which employ separate sleeves and rings cushioned by O-rings on the spool to allow for any bending movement of the body which might result from anchoring of the valve assembly upon an uneven support.

These and other objects will be seen from the following specification and claims in conjunction with the appended drawing.

THE DRAWINGS

FIG. 1 is a plan view of the present lapped spool valve assembly as mounted upon a support fragmentarily shown.

FIG. 2 is a front elevational view thereof.

FIG. 3 is a rear elevational view thereof taken in direction of arrows 3—3 of FIG. 1.

FIG. 4 is a right end elevational view thereof.

FIG. 5 is a longitudinal section thereof taken in direction of arrows 5—5 of FIG. 2.

FIG. 6 is a longitudinal section of a modified spool assembly.

FIG. 7 is a similar view of a still further modified spool assembly.

It will be understood that the above drawings illustrate merely several preferred embodiments of the invention, and that other embodiments are contemplated within the scope of the claims hereafter set forth.

DETAILED DESCRIPTION OF AN EMBODIMENT OF THE INVENTION

Referring to the drawing, the present lapped spool valve assembly is generally indicated at 11, FIGS. 1 and 5 mounted upon support S, fragmentarily shown in FIG. 1. The valve assembly includes an elongated body 13 of a hard material such as steel, having a bore 15 which has been honed to an exact dimension and has a fine finish.

Reciprocal spool assembly 17 consisting of two or more spools 19 is reciprocally and snugly nested and sealed within said bore. The spools are made of a hard material such as steel and similarly have been honed to an exact dimension having a fine finish so as to match said bore with a minimal clearance. Thus annular portions of the spools within said bore sealingly engage said body for controlling the flow of fluids, such as compressed air or hydraulic fluids, to and through the respective bores and passages therein.

End caps 23 having annular cap seals 25 are mounted over opposite ends of the body and secured thereto by fasteners 27.

In one position of mounting, the body 13 is applied to the support surface S FIG. 1, and secured thereto by a plurality of fasteners 29 which extend through corresponding openings formed transversely through the body.

Conventional pressure ports, exhaust ports and cylinder ports are provided for the present valve assembly. As shown in FIG. 5 there is a single pressure port P and associated passage within the valve body adapted for connection with a suitable source of pressure such as compressed air or hydraulic fluid under pressure. Also formed within the body are a pair of spaced cylinder ports C with associated passages within the body which are connected by conduits 45 and 47 respectively to a cylinder assembly 43 which includes the usual reciprocating piston and connected piston rod.

There also provided upon the body a pair of exhaust ports X with associated passages all in communication with the bore 15. Said ports and passages under the control of the spool assembly 17 determine the flow of pressure fluid and exhaust to and from opposite ends of the cylinder assembly. In some forms of valve constructions these spool assemblies have a normal central position and this is normally accomplished by having outwardly opening pockets 31 in the outer ends of the spools 19 adapted to receive coiled compression springs such as the spring 33 shown at one end in FIG. 5. In the event that there is employed a centrally positioned spool assembly employing a pair of such springs, the spool assembly will have a central blocking position against all flow and exhaust. The spool is selectively movable to additional positions adjacent opposite ends of the bore, one of which is shown in FIG. 5.

In the illustrative embodiment of the invention a single spring 33 is used, for illustration, which normally biases the spool assembly to the extreme control position shown in FIG. 5. By this construction pressure fluid at port P is delivered through channel 51 and conduit 45 to the cylinder assembly 43. Exhaust returns through conduit 47, the cylinder port C and associated passage through annular channel 49 within one of the spools 19 to the exhaust port X.

Some means is employed for effecting, selectively, movement of the spool assembly to the opposite position from that shown in FIG. 5. In the illustrative embodiment, such means includes a pilot air source 39 of compressed air which is connected by conduit 41 and a suitable fitting to the axial passage 35 in the adjacent end cap 23. The port 37 in said end cap is in communication with bore 15 and adjacent pocket 31 at the end of spool 19. Accordingly, when the pilot air control is activated, the spool assembly 17 will move from the position shown in FIG. 5 to the extreme right hand position against the action of spring 33. This will reverse the flow of pressure fluid from port P so that said fluid is delivered through conduit 47 to the cylinder assembly with exhaust returning through conduit 45 back to bore 15 and through the other exhaust port X.

Since the means by which the spool assembly is moved from a central blocking position to either of a pair of control positions, forms no part of the present invention, further detail is omitted. The present invention is primarily directed to the construction of the body and its highly finished accurate bore sealing therein a highly finished spool assembly having a minimal clearance in the range of 10 millionths of an inch, approximately. This clearance could range between 10 and 25 millionths. This provides a means by which the spools are sealingly mounted within the bore and at the same time capable of controlling a selective flow of pressure fluids through the respective ports or passages.

Flexibility of the spool assembly is provided by employing two or more spools 19, FIG. 5 which are flexibly interconnected in various ways as in FIGS. 5, 6 and 7. In the embodiment shown in FIG. 5, the spools have opposed elongated over sized bores 53 which terminate in counter bores 55. An elongated flexible wire 57, which is hardened and preferably is stainless steel, extends through the bores 53 of the spaced apart spools 19. The ends of the wire extend into the counter bores 55 and are suitably secured to the respective spools as by welds 59, for illustration.

Since there is a clearance between the wire and bores 53, there is a flexible connection established between the spools 19 which are considerably shorter than the full length of the bore and thus provide a degree of flexibility in the spool assembly. This eliminates any possible sticking which might occur due to body warpage, if the fasteners 29 secure the valve body to an uneven surface. Should there be any such warping, the construction of the valve spool assembly using a plurality of spools will eliminate any sticking. Sticking is furthermore minimized since the length of the individual spools is much less than the total length of the bore. In FIG. 5 illustrated one form of flexible connection between the spools 19.

A modified spool assembly is shown in FIG. 6 wherein the spools 61 are arranged end to end and provide a flexible connection 63 therebetween. Here there is provided the tongue 65 of predetermined shape, such as T-shaped in cross-section, which is loosely disposed within a singularly shaped undercut slot 67 formed in the end of the adjacent spool.

A modified spool assembly is shown in FIG. 7 wherein the spools 69 are interconnected by a ball and socket connection. One spool end has a ball 71 which is swivelly nested within an adjacent socket 73 of the other spool.

There could be employed a universal joint between the two spools though the usage of such joint would be more costly than the flexible connection shown in FIGS. 5, 6 and 7.

Each of the spools have an annular groove 49. An end portion of the spools have an annular formation of reduced dimension which together form an additional annular groove 51 between the spool ends. These grooves cooperate with the adjacent ports and passages by which the spool assembly is adapted to control the flow of pressure fluid through the valve body.

By the present construction and particularly due to the exact dimensions and honing of the bore 15 of the body and the exterior surfaces of the valve spools 19, there is such minimal clearance between the parts that the spools in their various control positions are sealed within the body of the selective control of the flow of pressure fluid through the respective ports and passages and with respect to the cylinder assembly 43.

By the present construction the conventional spacers, rings and seals and the flexible spool seals such as employed in U.S. Pat. No. 3,017,901, are all omitted. The complete sealing is achieved by the minimal clearance between the respective spools and the body bore. This fit is further achieved due to the flexible connection between the respective spools which form the spool assembly.

Having described my invention reference should now be had to the following claims.

I claim:

1. A valve assembly comprising an elongated body having an axial bore defining an annular valve seat, said bore being honed to a fine finish;

axially apertured end caps sealed over and secured to opposite ends of said body;

said body having a pressure port, cylinder ports and exhaust ports, all with associated passages communicating with said bore;

a valve spool assembly reciprocally and snugly nested and sealed within said bore;

said spool assembly being honed to a fine finish to match the bore with a minimal clearance;

annular portions of said spool assembly sealingly engaging said bore controlling the flow of pressure fluid through the respective bores and passages;

said spool assembly having a central fluid shut-off position and a pair of fluid control positions;

means on said body for alternatively positioning said spool axially into one of said control positions;

said spool assembly including a pair of spaced symmetrical oppositely arranged axially aligned spools; and means flexibly interconnecting said spools;

the length of the spools relative to said bore, providing flexibility of the spools within said bore;

said interconnecting means including a wire axially extending loosely through said spools and at its ends secured to said spools respectively.

2. In the valve assembly of claim 1, said minimal clearance being 0.000010 inches approximately.

3. In the valve assembly of claim 1, said minimal clearance being in the range of 10 to 25 millionths of an inch, approximately.

4. In the valve assembly of claim 1, each spool having opposed axial bores; said wire extending loosely through said bores.

5. In the valve assembly of claim 1, the securing of said wire ends to said spools including an axial counter bore within each spool; said wire ends extending into said counter bores and welded to adjacent portions of said spools.

* * * * *